United States Patent [19]

Cantile

[11] Patent Number: 4,627,222

[45] Date of Patent: Dec. 9, 1986

[54] SYSTEM FOR IN-LINE PROCESSING OF ENVELOPES AND THE LIKE

[75] Inventor: Jack W. Cantile, Richmond, Va.

[73] Assignee: Hammermill Paper Company, Erie, Pa.

[21] Appl. No.: 387,106

[22] Filed: Jun. 10, 1982

[51] Int. Cl.[4] ..... B65B 35/30

[52] U.S. Cl. ..... 53/443; 53/154; 53/240; 53/58

[58] Field of Search ..... 53/154, 240, 443, 540; 270/1.1, 9, 12, 18, 58; 271/9

[56] References Cited

U.S. PATENT DOCUMENTS

| | | | |
|---|---|---|---|
| Re. 29,105 | 1/1977 | Miaskoff et al. | 271/9 X |
| 1,300,295 | 4/1919 | Pritchard | 270/18 |
| 3,048,099 | 8/1962 | Davidson et al. | 270/58 X |
| 3,166,309 | 1/1965 | Pidgeon | 270/1.1 |
| 3,692,298 | 9/1972 | Peacock | 270/58 X |
| 3,823,934 | 7/1974 | Parenti et al. | 270/18 |
| 3,892,427 | 7/1975 | Kraynak | 270/12 X |
| 3,966,186 | 6/1976 | Helm | 270/58 |
| 4,017,004 | 4/1977 | Onoe et al. | 271/9 X |
| 4,034,974 | 7/1977 | Maopolski | 270/18 X |
| 4,077,181 | 3/1978 | Asher et al. | 53/154 X |
| 4,121,818 | 10/1978 | Riley et al. | 270/58 X |
| 4,125,253 | 11/1978 | Wangermann | 270/58 |
| 4,428,501 | 1/1984 | Osako | 271/9 X |

*Primary Examiner*—John Sipos
*Assistant Examiner*—Steven P. Weihrouch
*Attorney, Agent, or Firm*—Fitch, Even, Tabin & Flannery

[57] ABSTRACT

A system for in-line processing of envelopes and the like includes a first upstanding feed hopper for feeding primary rectangular envelopes through a first printer press operative to print predetermined indicia on the primary envelopes after which they are conveyed in the direction of their major longitudinal axes through an inserter station operative to insert special event envelopes between selected ones of the primary envelopes. The primary and insert envelopes are conveyed in-line past an ink jet type printer operative to print particular customer data on each successive envelope making up a set, followed by automatic collating and insertion of sets of envelopes into cartons. A pulse encoder and photoelectric sensors cooperate with various elements of the system and an electronic data processor to effect automatic high speed operation of the system.

36 Claims, 13 Drawing Figures

12
16
56
54
52
92
50
60
98
104
106
96
80
58
110
108
68
66
82
5.
76a
74a
78a
76b
64
84
76a
78b
76d
78c
5.
70
78d
88
86

78a
74a
74b
76a
76a
76b
76b
78b
78c
76c
78d
76c
76d
76d 120a
118a
114
122
118b
120b
22

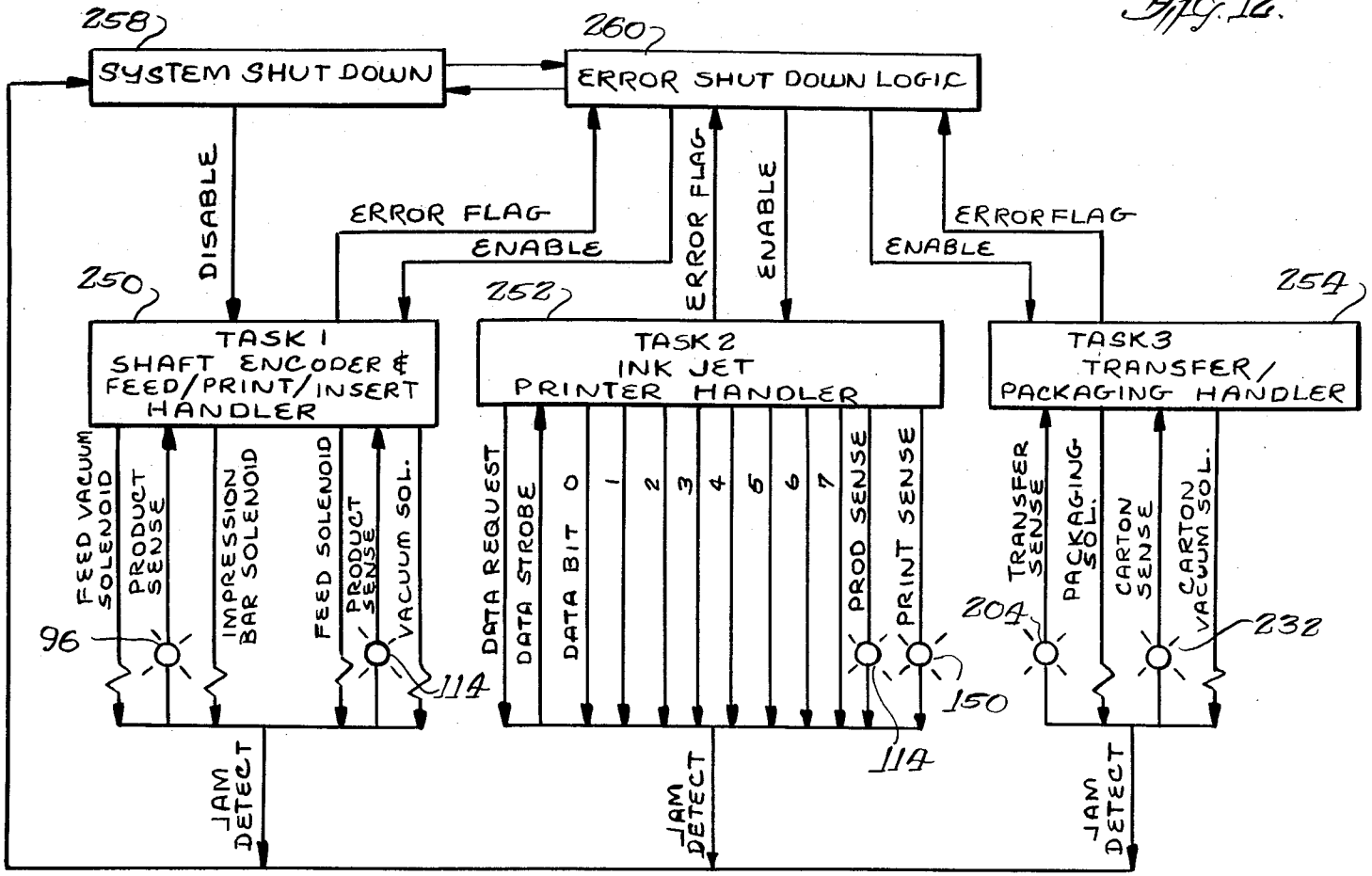
Fig. 12.
SYSTEM SHUT DOWN
258
ERROR SHUT DOWN LOGIC
260
DISABLE
ERROR FLAG
ENABLE
ENABLE
ERROR FLAG
ENABLE
ERROR FLAG
TASK 1
SHAFT ENCODER &
FEED/PRINT/INSERT
HANDLER
250
TASK 2
INK JET
PRINTER HANDLER
252
TASK 3
TRANSFER/
PACKAGING HANDLER
254
FEED VACUUM SOLENOID
PRODUCT SENSE
IMPRESSION BAR SOLENOID
FEED SOLENOID
PRODUCT SENSE
VACUUM SOL.
DATA REQUEST
DATA STROBE
DATA BIT 0
1
2
3
4
5
6
7
PROD SENSE
PRINT SENSE
TRANSFER SENSE
PACKAGING SOL.
CARTON SENSE
CARTON VACUUM SOL.
JAM DETECT
JAM DETECT
JAM DETECT
96
114
150
204
232

SYSTEM FOR IN-LINE PROCESSING OF ENVELOPES AND THE LIKE

BACKGROUND OF THE INVENTION

The present invention relates generally to systems for processing envelopes and the like, and more particularly to a novel system for automatic in-line printing, numbering, dating, collating and packaging of a substantially continuous flow of envelopes in the form of primary envelopes between which insert envelopes may be selectively positioned as the primary envelopes are conveyed along a predetermined path.

It is a conventional practice in many organizations, and particularly church congregations, to provide envelopes to members in which regular donations or offerings may be made for financial support. In the case of church offerings, the envelopes are generally of smaller size, such as approximately $3\frac{1}{4}\times6\frac{1}{4}$ inch rectangular shape, than conventional letter size envelopes. The front face of each envelope is commonly imprinted with the name of the church and frequently the particular purpose of the envelope, such as "Weekly Offering". A set of such envelopes is generally contained within a carton, with each envelope being serially numbered and dated to indicate the date on which the envelope is to be used. Frequently, one or more insert or special envelopes are intermixed in selected date order with the main offertory envelopes so as to remind the church member of a particular church activity or special offering during the church year.

Traditionally, envelopes, such as offertory envelopes, which are to be packaged as primary envelopes in predetermined order in relatively small individualized cartons have been prepared by printing desired indicia on each envelope at a first operating station, and thereafter transporting a quantity of the printed envelopes to a separate inserter station for either manual or mechanical insertion of special insert envelopes at selected positions between the primary envelopes. In accordance with known prior practices, the primary envelopes are printed with particular customer indicia, such as the name and/or logo of the organization, by means of a print cylinder as they are fed from a hopper onto a conveyor for transfer to the inserter station. Prior to reaching the inserter station, the primary envelopes are further printed with the date on which the envelope is to be used, and a serial number common to each envelope in a given set. This requires that the insert envelopes be pre-printed to indicate not only the particular event for which they are to be used, such as a Thanksgiving offering, but also the date of the corresponding event and a serial number matching the serial number printed on the primary envelopes making up the set into which the insert envelopes will be inserted. Thereafter, the envelopes are collated into sets and packaged into individualized cartons.

A significant drawback in the aforedescribed manner in which primary and insert envelopes and the like have heretofore been printed and collated is that should a particular job or "run" of envelopes be changed, such as by reducing the number of primary and insert envelopes which are to make up a given set, substantial waste is incurred due to the pre-printed but unused insert envelopes. A further drawback is that the prior techniques have required relatively high labor intensity which contributes significant expense to the effort of soliciting contributions from church members. Since the use of such offertory envelopes is widespread and entails substantial numbers of envelopes, it will be appreciated that significant cost reductions can be realized if the process of printing primary envelopes, selectively inserting special insert envelopes between the primary envelopes, sequential numbering and dating, and collating and packaging into individualized cartons can be improved so as to reduce both waste and the labor cost factor.

SUMMARY OF THE INVENTION

In accordance with the present invention, a system is provided for performing a predetermined sequence of in-line operations on rectangular shaped envelopes and the like which includes an upstanding main feed hopper and associated printing means for sequentially feeding in a predetermined order and printing indicia, such as a church name and/or address, on the faces of primary envelopes which are then conveyed along a predetermined path to an inserter station having a plurality of upstanding inserters operative to selectively insert special insert envelopes in predetermined positions between the primary envelopes. From the inserter station, the envelopes pass through a second printer station operative to print individualized indicia, such as a customer identification number and date, on each successive envelope. The envelopes are then deposited in predetermined quantity sets or batches into a transfer station which transfers successive sets to a packaging station operative to insert each set or batch into a customer carton and convey the cartons to a final discharge station. A data processor control is operative in response to process interrupts to control the envelope main feeder and inserters, the printers and transfer and packaging stations. Photoelectric sensors are operative with various elements of the system to detect envelope movement and printing quality and cooperate with the data processor control to automatically cease operation of the system upon detection of predetermined events.

Accordingly, a general object of the present invention is to provide a novel system for in-line printing, numbering, collating and packaging of envelopes and the like which provides significant advantages over prior known systems.

A more particular object of the present invention is to provide a novel system for automatic substantially in-line processing of envelopes wherein primary envelopes are fed from a main hopper in a predetermined sequential order through a printer operative to print identical data on each successive primary envelope after which the primary envelopes are conveyed along a predetermined path with their major longitudinal axes parallel to the direction of travel. The primary envelopes are passed through an inserter station during which insert envelopes may be automatically inserted between selected ones of the primary envelopes, followed by passage of the primary and insert envelopes through a second printing station operative to print individualized indicia, such as a serial number and date, on each successive envelope. The envelopes are then passed to a collating and transfer station which transfers batches or sets of envelopes to a packaging station for packaging into individual cartons.

In accordance with one feature of the present invention, a pulse encoder and photoelectric sensors are operatively associated with the various operating stations and provide pulse signals to a data processor operative to establish predetermined spacing between the primary envelopes, insert special insert envelopes into selected spaces created between the primary envelopes, pass the envelopes in-line through a printing station and print individualized data on each successive envelope, and thereafter transfer the envelopes in predetermined collated sets to a packaging station operative to automatically insert each set into an individual carton.

Another feature of the envelope processing system in accordance with the present invention lies in the provision of means for conveying rectangular primary and insert envelopes and the like along a predetermined path with the envelopes having their major longitudinal axes parallel to the path of travel, and high speed printing means in the form of an ink jet type printer operative to apply in-line printing of selected data on successive envelopes in the direction of their major longitudinal axes without mechanical contact therewith.

Another feature of the present invention lies in the provision of a novel transfer station having a pair of generally parallel turner members which are mutually cooperable to receive successive envelopes in stacked relation, and which are rotatable about their respective axes in response to command signals to deposit a selected quantity or set of stacked envelopes into a receiving tray.

Further objects and advantages of the present invention, together with the organization manner of operation thereof, will become apparent from the following detailed description of the invention when taken in conjunction with the accompanying drawings wherein like reference numerals designate like elements throughout the several views.

BRIEF DESCRIPTION OF THE DRAWINGS

FIG. 12 is a task control logic diagram for the control logic block diagram illustrated in FIG. 13.

DETAILED DESCRIPTION OF PREFERRED EMBODIMENT

Figure 1:
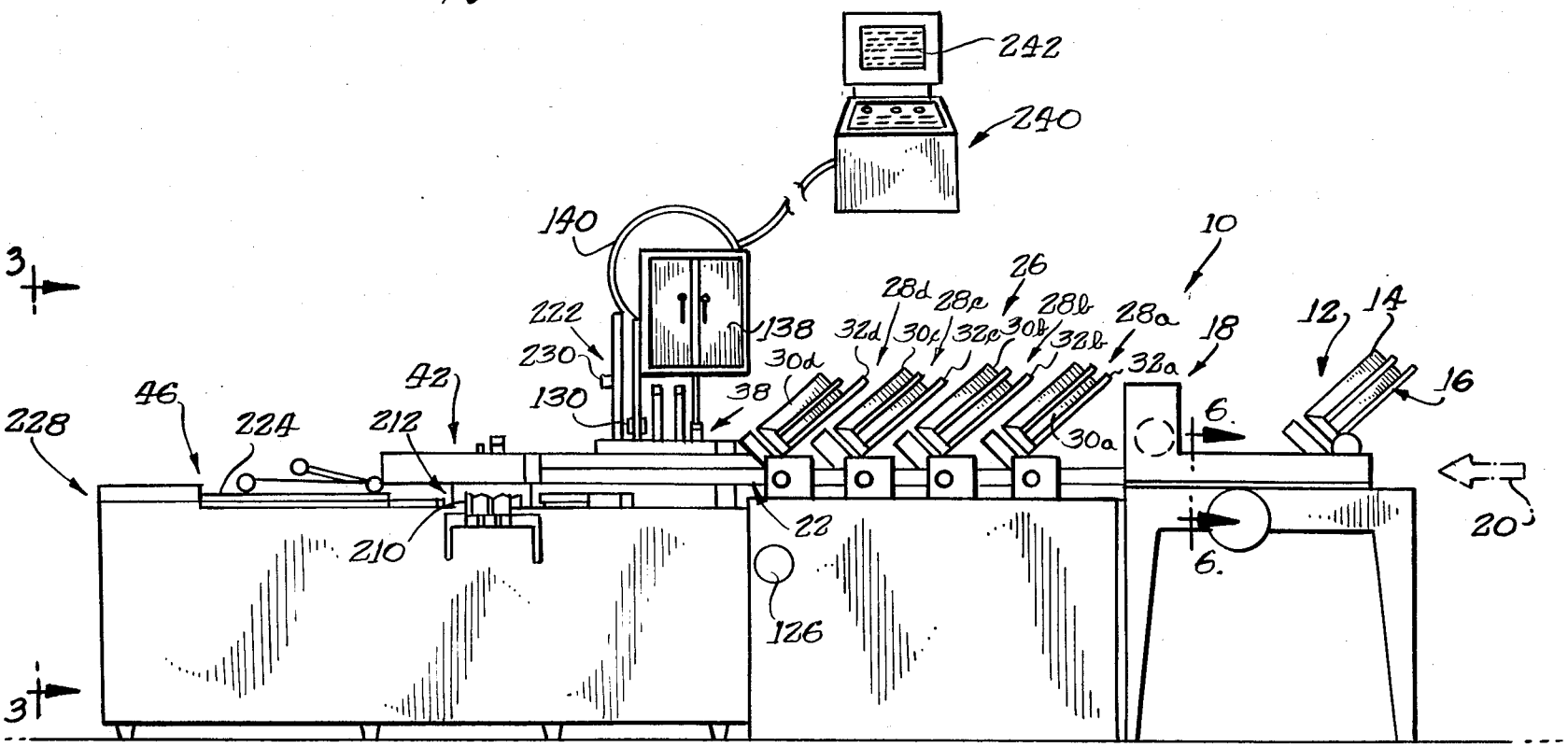
FIG. 1 is a schematic elevational view of a system for in-line processing of envelopes in accordance with the present invention.
Figures 2, 11:
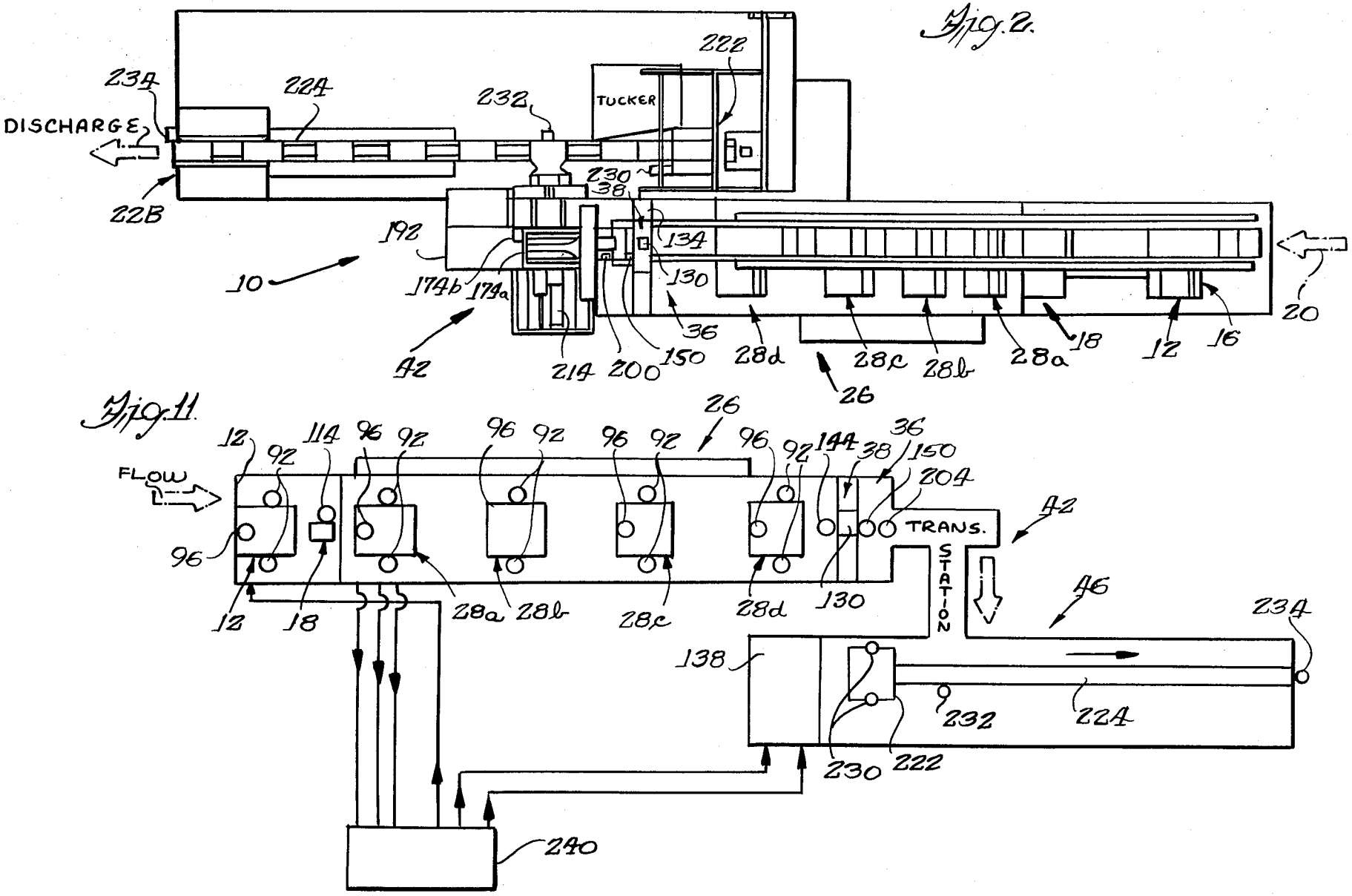
FIG. 2 is a schematic plan view of the system illustrated in FIG. 1.
FIG. 11 is a schematic diagram of the system of FIGS. 1 and 2 showing the location of the photoelectric sensors.
Figure 3:
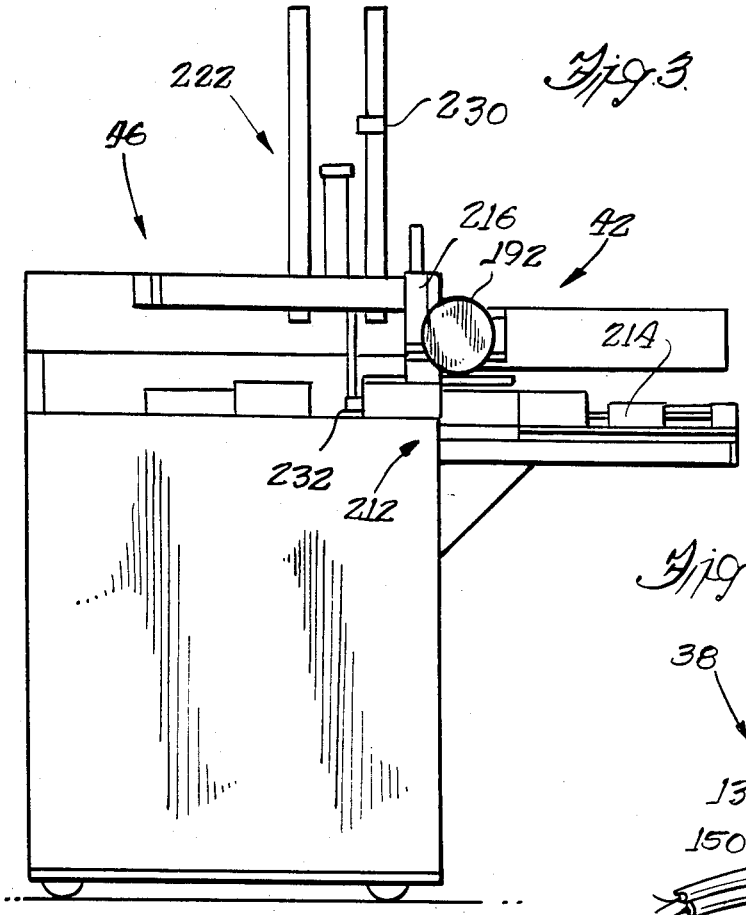
FIG. 3 is an end view taken substantially along line 3—3 of FIG. 1.

Referring now to the drawings, and in particular to FIGS. 1-3, a system for in-line processing of generally rectangular flat envelopes and the like is indicated generally at 10. Very generally, the envelope processing system 10 is operative to automatically perform a predetermined sequence of in-line operations on rectangular envelopes which, in the illustrated embodiment, comprise primary envelopes and insert or special envelopes which are automatically collated in a predetermined order with the primary envelopes and are packaged in cartons so that each carton contains a predetermined number or set of envelopes comprising insert envelopes selectively intermixed with the primary envelopes. As will become more apparent hereinbelow, the envelope processing system 10 finds particular application in the processing of envelopes which have conventionally been employed as offertory envelopes by church members for use in weekly and special occasion financial offerings. While the system 10 is described herein in conjunction with in-line processing of rectangular envelopes, it will be appreciated that the system may find other applications wherein it is desired to automatically process in-line generally rectangular flat sheets of paper material or the like which are to be selectively printed and which are to have insert sheets selectively interpositioned therewith followed by automatic collating and packaging into predetermined sets or batches.

The system 10 is operative to automatically effect in-line feeding and printing of primary envelopes, insert special "insert" envelopes into the conveyed stream of primary envelopes, print individualized indicia on each successive envelope, and collate and package the envelopes into cartons. To this end, the system 10 includes first hopper and feeder means, indicated generally at 12, for supporting a plurality of substantially flat primary rectangular envelopes 14 in an upstanding hopper 16 and sequentially feeding the primary envelopes to first printer means, indicated generally at 18, in response to command signals to be hereinafter described. In the illustrated embodiment, the envelopes making up the stack of primary envelopes 14 are of rectangular configuration, such as approximately $3\frac{1}{4}\times6\frac{1}{4}$ inch size, and are supported in generally upstanding relation by the hopper 16 such that they are fed to printer means 16 with their major longitudinal axes disposed substantially parallel to the direction in which they are to be conveyed in-line through the system 10, as represented by arrow 20 shown in FIGS. 1 and 2.

The first printing means 18 is operative to print predetermined indicia on the upwardly facing surface of each successive envelope 14 fed to the printer means on conveyor means, indicated generally at 22, from hopper 16. Such predetermined indicia may, for example, comprise the name and/or address of a particular church along with associated art work as may be desired such as a logo or artist's rendering of the church. The printer means 22, which may be termed the first work or operating station, comprises a cylinder and plate type printer and is operative in response to first print command signals to print the predetermined indicia on the primary envelopes 14 as they pass through the printer in the direction of their major longitudinal axes. From the first printer means 18 the primary envelopes are sequentially conveyed by conveyor 22 along a predetermined path to a second work or operating station, termed the inserter station and indicated generally at 26. In the illustrated embodiment, the inserter station 26 includes four inserters, indicated generally at 28*a*, 28*b*, 28*c*, and 28*d*, each of which is adapted to support a plurality of special or insert envelopes indicated at 30*a*, 30*b*, 30*c* and 30*d*, respectively, in a corresponding generally upstanding hopper 32*a–d*. The insert envelopes 30*a–d* are of the same rectangular shape and size as the primary envelopes 14 and are manually placed in the upstanding hoppers with their major longitudinal axes disposed parallel to the direction of the path along which the envelopes are conveyed by the conveyor 22.

As will be described, the first hopper and feed means 12 is operative in response to predetermined command signals to establish spaces between selected ones of the primary envelopes 14 discharged from the hopper feed so that the spaced primary envelopes remain in their spaced relation as they move through the printer means 18 on the conveyor 22. As used herein, the term "space" or "spaces" referred to as being created between selected ones of primary envelopes fed from the hopper and feed means 12 in response to command signals denotes a space of sufficient size to receive an insert envelope therein when disposed with its longitudinal axis parallel to the longitudinal axes of the primary envelopes. Each of the inserters 28*a–d* is operative upon receipt of a predetermined command signal to deposit a corresponding insert envelope into a selected space created between the primary envelopes 14 for this purpose as the primary envelopes are received from the first printer means 18. The insert envelopes in each of the stacks 30*a–d* may be pre-printed with indicia indicating a specific purpose. For example, the insert envelopes 30*a* might request funds to defray the cost of a years supply of offertory envelopes, while insert envelopes 30*b*, *c* and *d* might be designated for special offerings such as Easter, Thanksgiving and Christmas, respectively. Insertion of insert envelopes from the inserters 28*a–d* onto conveyor 22 is controlled by predetermined command signals so that only one insert envelope will be discharged from any one of the inserters into the space arriving at the selected inserter for this purpose from the printer means 18.

The conveyor means 22 is operative to advance the primary envelopes 14 thereon and any insert envelopes 30*a–b* which have been selectively positioned between the primary envelopes to a third work or operating station, indicated generally at 36, at which is located second printing means indicated generally at 38. The second printing means 38 is operative to print individualized indicia, such as a date and an individual customer identification or serial number, on each individual envelope passed through the operating station 36. For example, where the envelopes are to be used as offertory envelopes, the envelopes may be serially numbered and dated by the second printing means 38 in response to predetermined command signals, as will become more apparent hereinbelow.

From the second printing station 36, the primary and insert envelopes are conveyed by conveyor 22 to a fourth work or operating station, indicated generally at 42, which comprises a transfer station. The transfer station 42 is operative to receive envelopes in stacked relation therein. When the transfer station has received a predetermined number of envelopes to constitute a set or batch, it is caused to transfer the set of envelopes to a packaging station, indicated generally at 46. The packaging station 46 is operative to automatically insert each set of envelopes into an individual tuck style carton which has been automatically erected in the packaging station after which the carton is closed and conveyed to a discharge position on the packaging station for packing into a shipping container.

Figure 4:
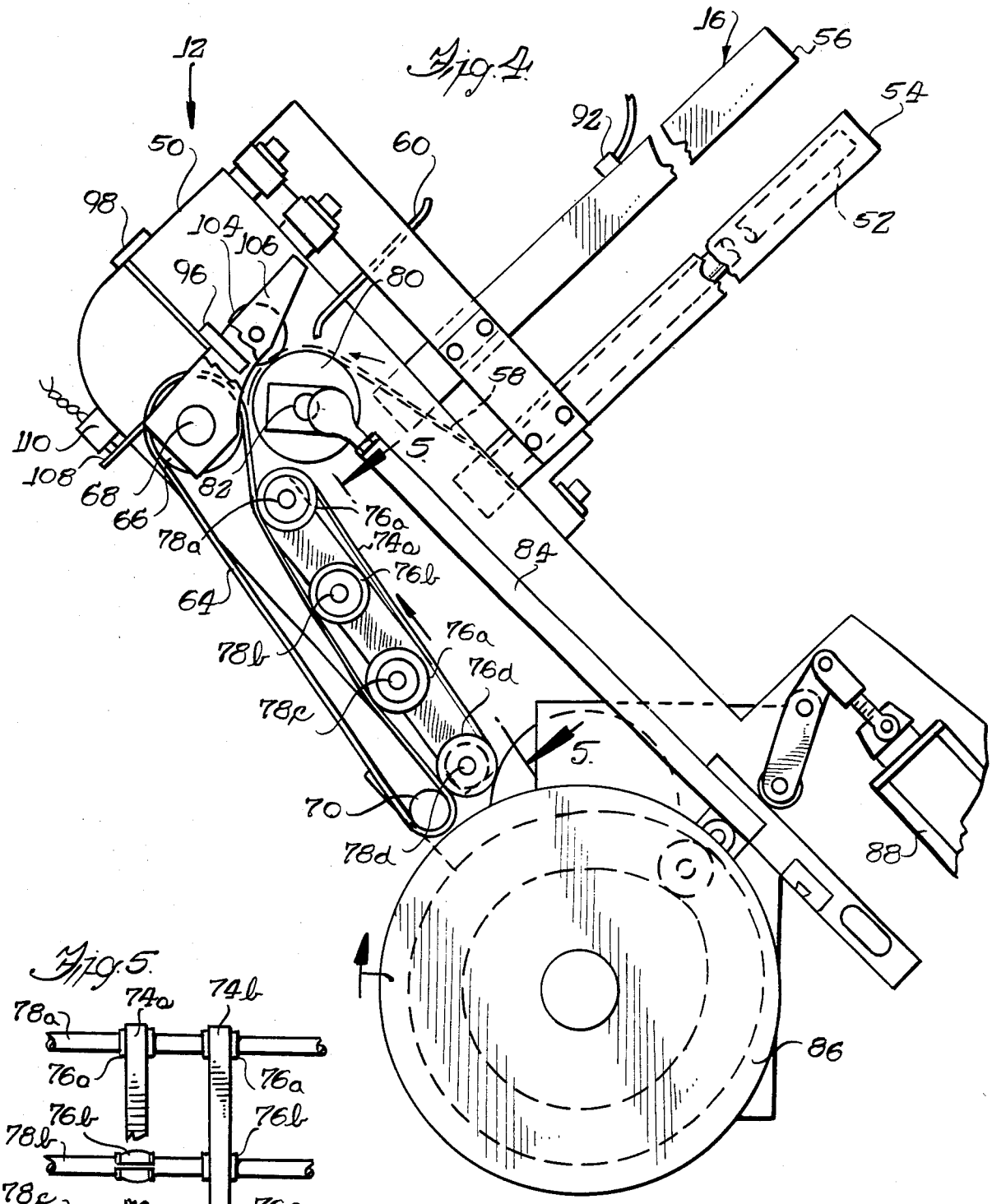
FIG. 4 is a schematic side view of the primary envelope feeder with one of its side plates removed.
Figure 5:
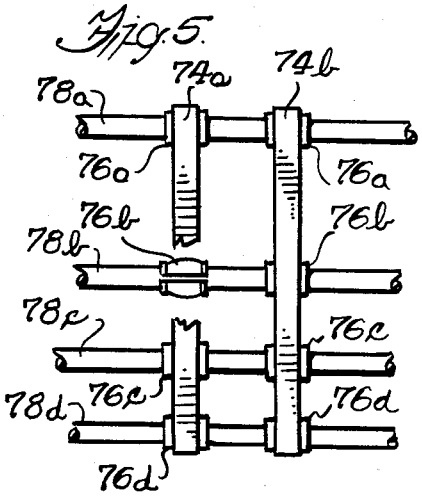
FIG. 5 is a fragmentary sectional view of the main envelope feeder taken substantially along line 5—5 of FIG. 4.

Turning now to a more detailed description of the envelope processing system 10, the first hopper and feed means 12 may comprise a known feeder and printing press such as commercially available from Halm Industries Co., Inc., as its Model No. JP-6 printing press but having some modifications as hereinafter described. Referring to FIGS. 4 and 5, the hopper and feed means 12 includes a pair of laterally spaced side frame members, one of which is shown at 50 in FIG. 4, on which are mounted a pair of laterally spaced upstanding rods 52 and two pairs of laterally spaced upstanding bars 54 and 56. The rods and bars 54, 56 define the hopper 16 and are adapted to receive and maintain a stack of primary envelopes in predetermined relation to the feeder with the major longitudinal axes of the rectangular envelopes substantially parallel to the direction in which the envelopes are fed to the conveyor means 22. A support plate 58 is mounted to lie beneath and between the pairs of guide bars 54 and 56 so as to support the envelopes within the hopper and prevent sagging thereof. A pair of envelope guides, one of which is indicated at 60, assist in maintaining the lower envelopes in the stack in proper position preparatory to feeding.

The feed means 12 includes a pair of laterally spaced feed belts, one of which is indicated at 64, which are supported at their upper ends on idler rollers 66 mounted on a transverse support shaft 68, and are supported at their lower ends on a transverse drive shaft 70 which is rotatably driven in predetermined timed relation with movement of the conveyor means 22, such as through a chain drive conventional with the aforementioned Halm Model JP-6. A pair of laterally spaced belts 74*a* and 74*b* are supported on respective sets of idler rollers 76*a–d* carried by transverse support shafts 78*a–d*, respectively, which have their opposite ends suitably journaled to the laterally spaced side frame members of the feeder means 12. The belts 74*a,b* are cooperative with the feed belts 64 and serve as presser or pressure belts to effect positive feed of successive envelopes from the hopper 16 to the conveyor means 22.

To effect selective feeding of primary envelopes from the hopper 16 to the nip defined by the engaging upper reaches of the feed belts 64 and presser belts 74*a,b*, a generally cylindrical suction block 80, which may be termed the sucker block, is mounted on a transverse support shaft 82 for rotation about its longitudinal axis. The sucker block has a connector rod 84 eccentrically connected thereto to enable selective rotation of the sucker block between forward and rear positions. The control rod 84 is connected at its lower end to a continually rotating cam drive 86 and has operative association with a feeder control solenoid 88 to enable selective feeding of envelopes from the hopper 16 through the feeder means 12, the cam drive 86 being interconnected to the conveyor chain drive so as to rotate in fixed relation to movement of the conveyor means 22 as is conventional with the Halm JP-6. The sucker block 80 has suction ports intersecting its peripheral surface which are connected to a source of vacuum (not shown) having a control solenoid operative therewith to facilitate selective feeding of primary envelopes 14 from the feeder means 12 and the establishment of selective spaces therebetween as will become more apparent hereinbelow in the description of the control logic. The vacuum supply and associated solenoid operated suction control valve are of known design.

With particular reference to FIG. 5, the pairs of presser belt support rollers 76*a–d* may be formed as semi-annular segments which are fixed on the respective support shafts 78*a–d*. The idler rollers are preferably slightly convexly crowned and have annular flanges at their opposite ends to maintain the associated presser belts 74*a,b* in generally fixed feeding relation with the feed belts 64. The presser belts 74*a,b* prevent the envelopes from wrinkling or buckling along their major longitudinal lengths as they are fed from the hopper 16 to the conveyor means 22. It will be appreciated that the feed belts 64 and associated presser belts 74*a,b* are spaced laterally apart a distance sufficient to effect desired engagement with the marginal edges of the envelopes to effect a desired positive feed control to the conveyor means 22.

A photoelectric sensor 92 is mounted on one of the upstanding guide bars 54 or 56 and is operative to photoelectrically detect the presence of envelopes within the hopper 16. The photoelectric sensor 92 may comprise a light emitting diode (LED) and a suitable phototransistor such as available from Skan-A-Matic Corp., Elbridge, N.Y., as its model L33/P33 series. A photoelectric sensor 96 is mounted on a suitable transverse support bar 98 fixed on the feeder means 12 so as to detect the feeding of envelopes by the sucker block 80. The photoelectric sensor 96 may comprise a photoelectric scanner of known design, such as available from Skan-A-Matic as its model S13255.

In the feeding of primary envelopes from the primary feed means 12 and insert envelopes from the inserters 28*a–d*, it is important that only one envelope at a time be fed to the conveyor means 22 from each of the primary and insert envelope feeders. To detect feeding of more than one envelope from any of the envelope supply hoppers, the main feeder 12 and each of the inserters 28*a–d* has a pair of pinch rollers, one of which is indicated at 104 in FIG. 4, rotatably carried on associated support arms 106 which are pivotally mounted on the transverse support shaft 68 such that the pinch rollers engage the outer peripheral surface of the associated sucker block so as to be moved pivotally outwardly from the sucker block as each envelope is fed to the feed belt 64. A switch actuator plate 108 is mounted on one of the support arms 106 and is operative to actuate a microswitch 110 which forms a double feed sensor and is connected in circuit with the overall control for the envelope processing system 10 in a manner to be described in greater detail hereinbelow.

As aforementioned, as the primary envelopes 14 are fed from the hopper and feed means 12, they are printed with indicia which, in the case of church offertory envelopes, may identify the particular church organization. The printer means 18 is a cylinder type press having an upper plate carrying cylinder and a lower impression cylinder between which the primary envelopes are passed from the feed means 12. In the illustrated embodiment, the upper plate cylinder is a "two-up" print cylinder, although a "one-up" print cylinder may also be employed. The lower impression cylinder is movable to press an envelope against the upper rotating plate cylinder under the control of an actuating solenoid (not shown) which is controlled by the control logic of the processing system 10 to be described. An envelope sensor in the form of a scanner type LED, indicated schematically at 114 in FIG. 11, is positioned between the printer means 18 and the feed belts 64 and is operative with the control logic to drop the impression cylinder away from the plate cylinder of the printer means 18 when a space previously established between the primary envelopes 14 reaches the printer means 18, thus preventing direct engagement of the impression cylinder with the upper plate cylinder.

Figure 6:
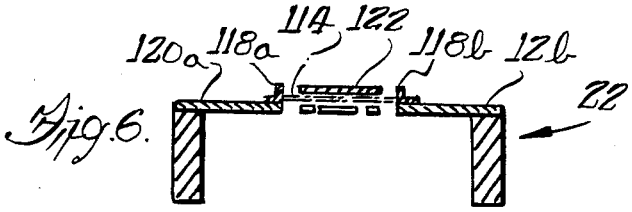
FIG. 6 is a fragmentary transverse sectional view taken substantially along line 6—6 of FIG. 1 and illustrating the lateral guides for the envelope conveyor.

The conveyor means 22 is of conventional design, such as available with the aforenoted Halm model JP-6 feeder and press, and employs endless chains having pusher members (not shown) carried thereon in predetermined longitudinal spaced relation so as to positively engage the rearward edge of each successive envelope deposited onto the conveyor means and effect positive controlled movement of the envelopes through the primary and insert envelope feed stations. As illustrated in FIG. 6, a pair of laterally spaced guide members 118*a* and 118*b* are mounted on generally horizontal support plates 120*a* and 120*b*, respectively, of the conveyor means 22 and serve to provide precise lateral guidance for the rectangular envelopes during movement along the conveyor means 22. An upper guide plate 122 is supported along the length of the conveyor means 22 to overlie the envelopes as they are moved between the first printer means 18 and the various inserters 28*a–d*, the plate 122 having suitable openings to enable insertion of insert envelopes onto the conveyor means as well as to facilitate printing by the high speed printer means 38 to be described.

The four inserters 28*a,b,c* and *d* may comprise a four station in-line inserting unit commercially available from Halm Industries Co., Inc. Each of the inserters 28*a–d* is generally similar to the aforedescribed hopper and feed means 12 for the primary envelopes, and each has been modified to provide positive feed presser belts as described in connection with the feeder means 12. The hoppers 32*a–d* on the inserters 28*a–d* are substantially identical to the hopper 16 for the primary envelopes and each has envelope level photoelectric sensor means thereon similar to the aforedescribed primary envelope level sensor 92. Each of the inserters 28*a–d* also has a photoelectric feed sensor and a double feed sensor which are connected in the control circuit for the processing system 10 in a manner to be described. The inserters 28*a–d* differ from the primary envelope hopper and feed means 12 in that each has upper and lower sucker blocks which are connected to the vacuum source and have solenoid actuated control valves operative to facilitate selective feeding of insert envelopes onto the conveyor means 22. In the inserters 28*a–d*, the solenoids operative to effect movement of the upper sucker blocks, termed the feed solenoids, receive signals separate from the signals applied to the solenoids controlling suction applied to the corresponding upper sucker blocks.

To establish pulse control signals in direct response to movement of the conveyor means 22, and thus establish a process interrupt for the data processor to be hereinafter described, a shaft encoder, indicated schematically at 126 in FIG. 1, is mounted on the support frame for the inserter station 26 and associated portion of the conveyor means 22. The shaft encoder 126 is driven off the main drive for the chain conveyor 22 as by being interconnected to the output shaft of the conveyor drive motor. The shaft encoder may, for example, comprise a rotary transducer that generates a pulse output proportional to shaft rotation such as commercially available from Dynapar Corporation under its trade name Rotopulser.

Figure 7:
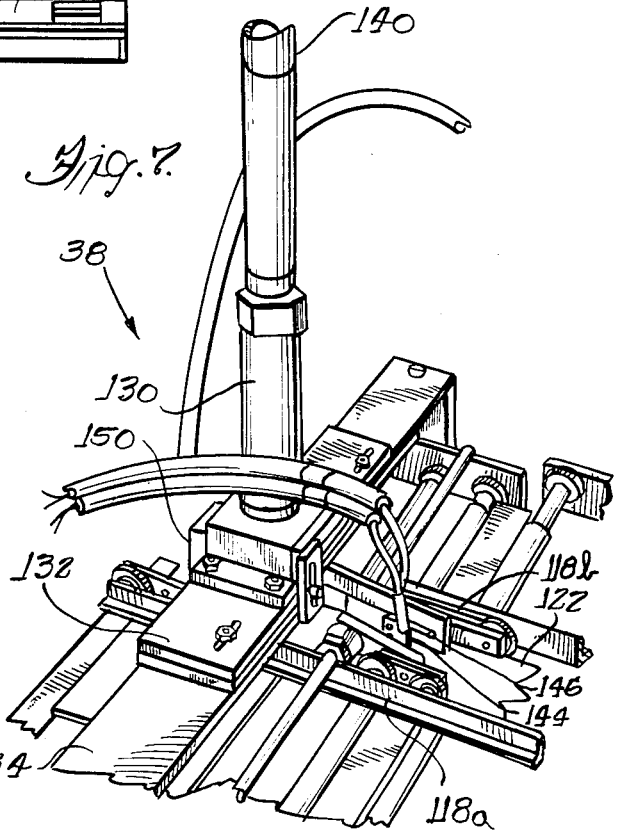
FIG. 7 is a fragmentary perspective view illustrating the high speed printer station.

As aforedescribed, when the primary and inserted insert envelopes are conveyed by the conveyor means 22 to the second printer means 38, each successive envelope is printed with individualized indicia such as a date and an identification or serial number which is to be common to each envelope of a set or batch of envelopes. Referring to FIG. 7, the second printer means 38 comprises a high speed ink jet type printer such as commercially available from A.B. Dick Company as its Model 9130 ink jet printer. In the illustrated embodiment, the high speed printer means 38 includes a generally cylindrical printhead 130 which is suitably supported in upstanding relation on a support plate 132 which, in turn, is supported on a support plate 134 mounted transversely of the conveyor means 22 in spaced relation thereabove. The support plate 132 is transversely adjustable along the support plate 134 to enable selective positioning of the printhead 130 relative to the transverse dimension of envelopes passing therebeneath, the support plate 134 having a suitable opening generally centrally therein to accommodate adjustment of the printhead. The printhead 130 is interconnected to a control console, indicated schematically at 138 in FIG. 1, through a flexible cable 140.

Operation of the printhead 130 is effected by the data control processor, to be described, in response to a process interrupt generated by a photoelectric sensor 144 mounted upstream from the printhead so as to detect the presence or absence of an envelope approaching the printhead from the inserter station 26. In the illustrated embodiment, the photoelectric sensor 144 comprises an LED reflective scanner such as the aforedescribed scanner sensor 94 and is supported by a suitable support bracket 146 mounted on the support plate 134 so that the photoelectric sensor 144 overlies the conveyor means 22 generally centrally between envelope guide members 118*a* and 118*b* which extend from the inserter station to and beneath the support plate 134 for the printhead 130.

A print sensor 150 is mounted on the support plate 134 downstream from the printhead 130 so as to directly overlie the in-line printing applied by the printhead in the longitudinal direction of each of the envelopes passed beneath the printhead. The print sensor 150 may comprise a color detection fiber optic scanner as commercially available from Skan-A-Matic as its S35 series. The print sensor 150 is capable of sensing the density of print applied by the printhead 130 and is connected in circuit with the system control circuit so as to "read" or sense print at specific locations along the length of each of the envelopes corresponding to predetermined positions in which print is to be applied by the printhead.

Figure 10:
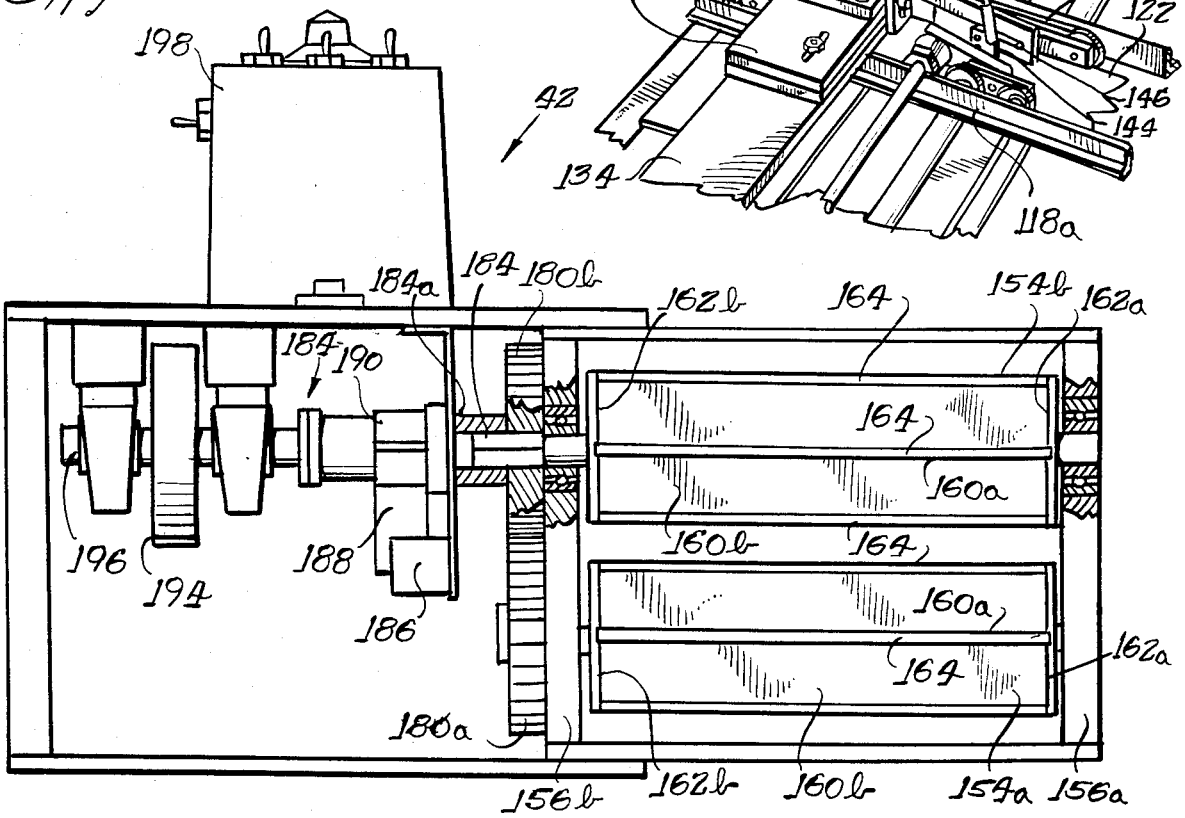
FIG. 10 is a bottom view of the transfer station of FIG. 8.
Figure 8:
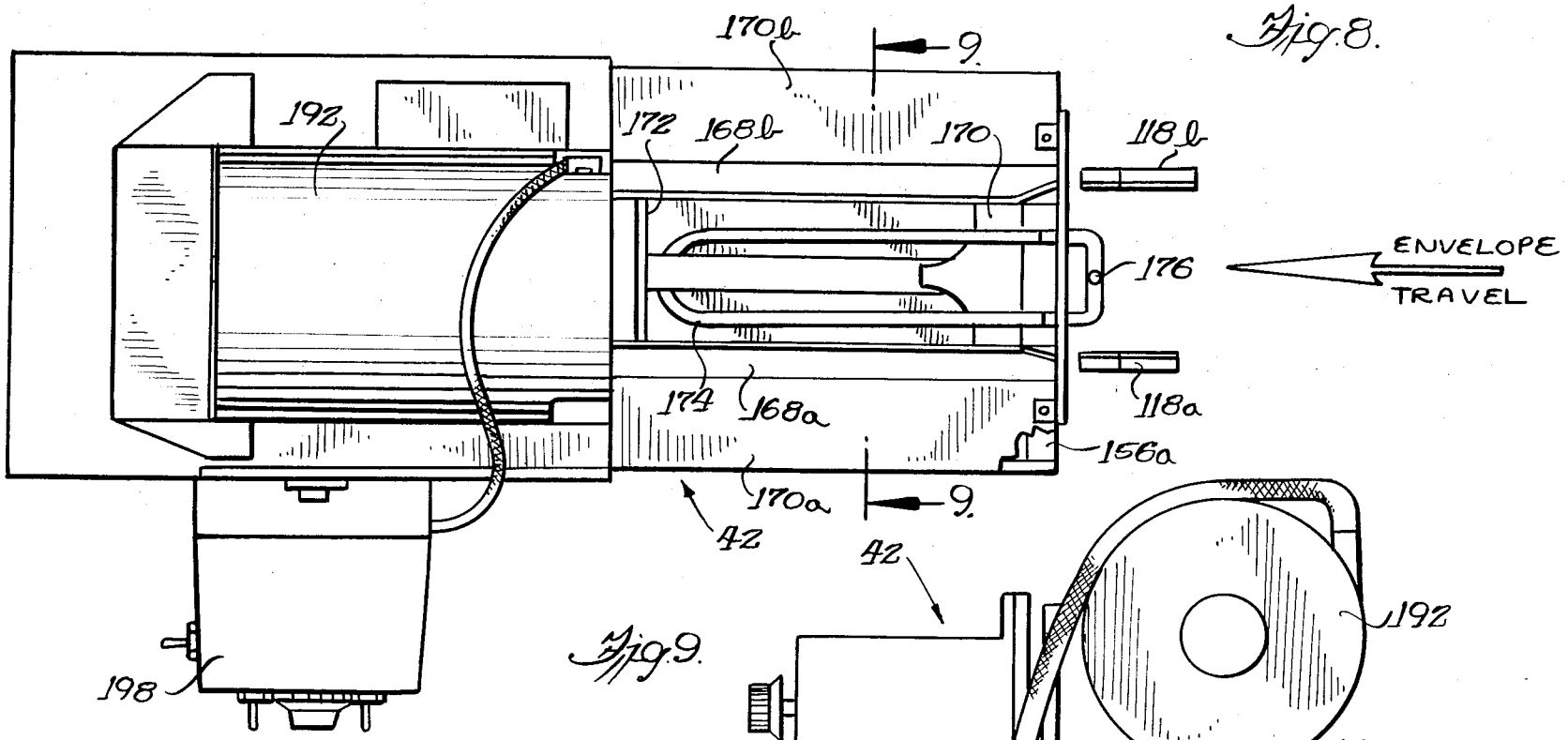
FIG. 8 is a plan view of the envelope transfer station.
Figure 9:
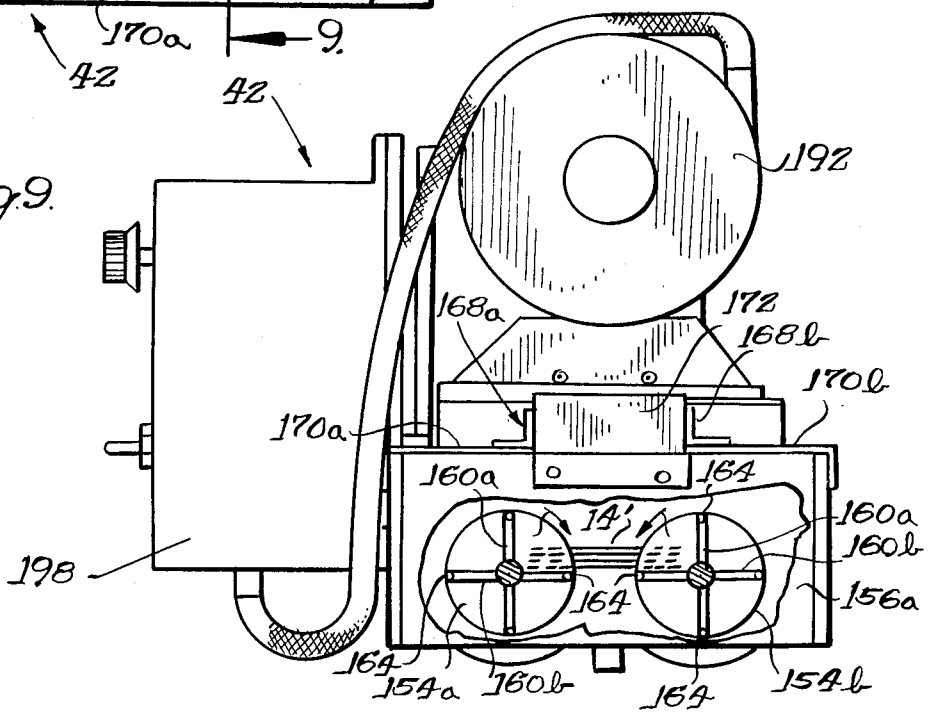
FIG. 9 is a fragmentary transverse sectional view of the transfer station taken substantially along line 9—9 of FIG. 8.

From the second printer means 38, the primary and insert envelopes upon which indicia has been printed by the printhead 130 are passed to the transfer station 42 by the conveyor means 22. Referring particularly to FIGS. 8–10, the transfer station 42 includes a pair of identical turner members 154*a* and 154*b* which are rotatably supported in parallel spaced relation by transverse support plates 156*a* and 156*b* as shown in FIG. 10. The turner members 154*a,b* are rotatable about their longitudinal axes which are parallel to the direction of envelope travel established by the conveyor means 22 and lie in a plane spaced below the plane of the conveyor 22 at its discharge end just downstream from the second printer means 38. Each of the turner members 54 has a pair of cross plates 160*a* and 160*b* which are perpendicular to each other and form four equal quadrants about their respective longitudinal axes. The cross plates 160*a,b* are suitably retained within cross-slots formed in mutually opposed surfaces of generally circular corresponding end plates 162*a* and 162*b* and are retained therein by connecting rods 164 engaging the outer edges of the cross plates 160*a,b* and having their opposite ends connected to the end plates 162*a,b*.

The turner members are mounted for movement through incremental 180° stepped rotation in opposite directions so that prior to and following each incremental rotation, the cross plates 160*a* and 160*b* are positioned to define an envelope receiving transfer tray operative to receive successive envelopes from the conveyor means 22, as indicated at 14' in phantom in FIG. 9. To assist in entry of the envelopes from the conveyor means 22, a pair of laterally spaced generally L-shaped guide members 168*a* and 168*b* are mounted on upper plates 170*a* and 170*b*, respectively, overlying the turner members 154*a,b* so that the guide members 168*a,b* define an opening therebetween of a width substantially equal to the lateral spacing between the guide members 118*a* and 118*b* of the conveyor means 22. To provide further assistance in entry of envelopes onto the turner members 154*a,b*, an entry plate 170 is mounted on the transverse support plate 156*a* and is configured to extend downwardly between the turner members as shown in FIG. 8. An envelope stop plate 172 is mounted on the opposite support plate 156*b* and provides a stop surface for engagement with the forward edges of the envelopes discharged from the conveyor means 22. Preferably, an air flow conduit 174 is supported to overlie the envelopes entering the transfer station 42 and is connected to a suitable air pressure supply (not shown) through an air supply tube 176 so that air may be discharged through suitable orifices in the air flow conduit and directed against the upper surfaces of envelopes passing into the transfer station.

Referring to FIG. 10, the turner members 154*a,b* are interconnected through spur gears 180*a* and 180*b* so as to effect synchronized equal rotational movement about their longitudinal axes. To effect such incremental rotation, the paddle member 154*b* has a square shaft end 182 which extends within a square bore drive hub 184*a* of a stepping or indexing clutch, indicated generally at 184. The clutch 184 is of known design, such as a Warner clutch model 305-20-008, and includes an electrical solenoid 186 operative to move a pivotally mounted break arm 188 into and out of engagement with the outer stepped surface of a clutch ring 190 such that momentary release of the clutch ring by the break arm 188 upon short pulse energizing of the solenoid 186 enables 180° rotation of the turner members 154*a,b*. Driving rotation of the turner members is effected by an electric motor 192 (FIGS. 8 and 9) having belt connection with a pulley 194 mounted on a shaft 196 axially connected to the clutch means 184. The drive motor 192 is adapted to be energized by the power supply to the envelope processing system 10, and has a suitable control box 198 enabling manual adjustment of motor speed and control of the power supply.

With the transfer station 42 as thus described, after delivery of a predetermined number of envelopes onto the turner members 154*a,b*, application of a pulse signal to the solenoid 186 is operative to release the break arm 188 and enable 180° rotation of the turner members which causes the accumulated envelopes to be dropped or dumped vertically downwardly and prepares the turner members to accumulate the next set of envelopes. To facilitate accumulation of a predetermined number of envelopes, such as fifty-six, within the transfer station 42, an envelope counter sensor 204 is suitably supported between the printhead 130 and the transfer station 42. The envelope counter sensor 204 is of the same type as the envelope presence sensor 144 and is connected in the control logic circuit for the system 10 in a manner to facilitate counting of envelopes passing beneath the sensor 204 and initiate transfer of successive sets of envelopes to the packaging station 46.

When a predetermined number of envelopes, such as 56, have been accumulated in the transfer station 42 equal in number to a predetermined set of envelopes, the transfer station is operative to automatically transfer the accumulated set of envelopes to the packaging station 46. In the illustrated embodiment, the packaging station 46 comprises an automatic cartoner such as commercially available from Container Equipment Corporation, Cedar Grove, N.J. as its Model 42-T intermittent motion automatic cartoner. Referring to FIGS. 1–3, the packaging station 46 includes an envelope receiving tray 210 which is adapted for movement between a first position underlying the turner members 154*a,b* of the transfer station 42 so as to receive envelopes from the turner members 154*a,b*, and a second position adjacent a carton loading station indicated at 212. Movement of the tray 210 is effected by a pneumatic double acting cylinder 214 controlled by the control circuit for the processing system 10 as will be described. A presser assembly cylinder, indicated schematically at 216, overlies the carton loading position 212 and is operative to compress the envelopes within the tray 210 so as to expel air from the stacked envelopes preparatory to inserting them within a carton. Limit switches (not shown) are provided for cooperation with the pusher cylinder 214 and the presser cylinder 216 to limit and control reciprocating movement of the associated tray 210 and a presser plate or shoe (not shown).

The packaging station 46 includes a carton supply hopper, indicated generally at 222, which overlies a carton chain conveyor 224 and is operative to receive a plurality of collapsed carton blanks preparatory to assembly into envelope receiving cartons. The packaging machine includes vacuum means (not shown) for withdrawing carton blanks from the hopper 22 and further includes means for erecting each successive carton blank so as to provide an open sided carton to the carton filling or inserter station 212 in preparedness for insertion of envelopes from the tray 210 as is known. Suitable tucking arms (not shown) are provided to automatically tuck the carton flaps into closed relation in a conventional manner after inserting a set of envelopes into each carton. From the carton insert station 212, the filled cartons are conveyed by the conveyor 224 to discharge position, indicated at 228, where the cartons are shingled and placed in larger cases by an operator.

A suitable photoelectric sensor 230 is mounted at a desired position on the carton blank hopper 222 to detect the level of carton blanks within the hopper. A scanner type photoelectric sensor 232 is mounted adjacent the carton insert station 212 to detect the presence of a carton. A photoelectric sensor 234 is provided at the discharge end of conveyor 224 to sense passage of filled cartons and thereby facilitate counting for completion of a job. The carton level sensor 230, carton presence detector 232, and filled carton sensor 234 are connected in the control circuit for the processing system 10.

The various photoelectric sensors employed in the illustrated embodiment of the envelope processing system 10 are illustrated schematically in FIG. 11 in relation to the primary hopper and feed means 12, inserters 28*a–d*, high speed printer means 38, transfer station 42 and packaging station 46. The various photoelectric sensors 92, 96, 114, 144, 150, 204, 230, 232 and 234 are shown in schematic relation to a data processor indicated schematically at 240. In the illustrated embodiment, the data processor 240 comprises an IBM Series I mini-computer having a cathode ray display tube 242 on which alphanumeric data is visually observable. The various photoelectric sensors provide signals to the data processor 240 in the form of interrupt signals indicating lack of envelopes or cartons within the hoppers 16, 32*a–d* and 222, absence of an envelope being fed by the feeders of the primary and inserter feeders 12 and 28*a–d*, respectively, absence of an envelope in position to be printed by the printer means 38, absence of proper printing on the envelopes performed by the printer means 38, the passage of successive envelopes into the transfer station 42, failure of a properly formed carton to appear at the carton loading 212 and the presence of filled cartons as sensed by the sensor 234.

Figure 13:
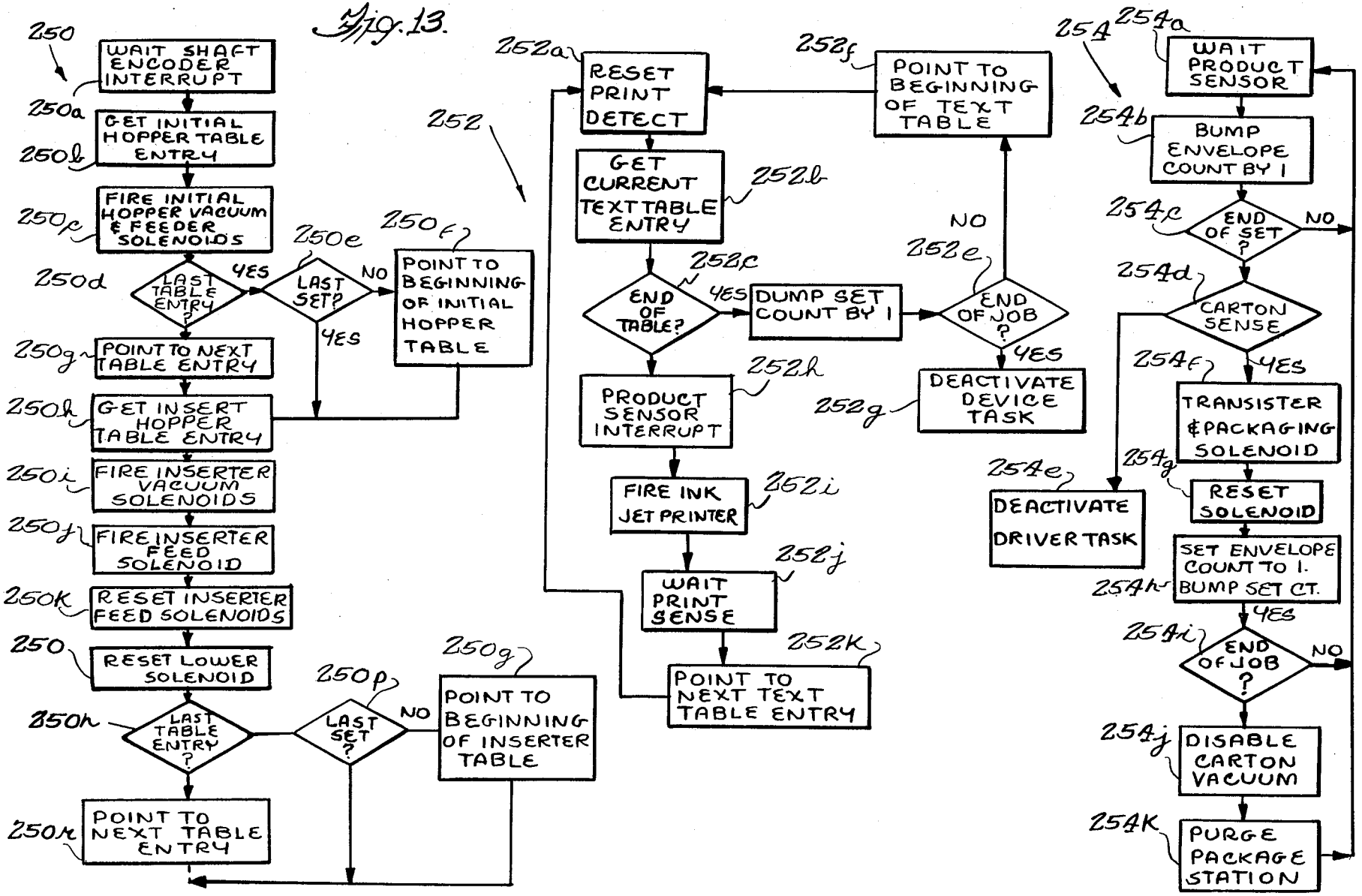
FIG. 13 illustrates in block diagram form the control logic for the data processor control employed with the system of FIGS. 1-3.

The operation of the envelope processing system 10 and the interrelationship of the various components will become apparent from the task control logic diagram illustrated in FIG. 12 and the control logic illustrated in block diagram form in FIG. 13. The logic control is broken into three logic tasks each of which resides in and is controlled by the data processor 240. Referring to FIG. 12, a first task is indicated schematically at 250 and controls feeding of envelopes from the primary envelope feeder means 12 and each of the inserter envelope feeders or inserters 28*a–d*. Release or feeding of envelopes from the primary hopper 16 and the establishment of spaces between selected ones of the primary envelopes, and the feeding of insert envelopes from the inserter envelope hoppers 32*a–d* is based on impulses received by the data processor 240 from the shaft encoder 126. Each pulse from the shaft encoder 126 causes the task program within the data processor 240 to be advanced or incremented to the next entry in the program table which controls each individual device by either energizing or resetting the device.

A second task logic is indicated at 252 in FIG. 12 and serves to control the second printer means 38 and establish the indicia printed in-line on each successive envelope by the printhead 130. The second task logic 252, which may be termed the ink jet printer handler logic, is based on an interrupt signal received from the product sensor 144. Each pulse interrupt from the sensor 144 causes the data processor 240 to advance to the next entry on the predetermined print program in memory within the data processor. The second task logic is independent of the shaft encoder 126.

A third task logic is indicated at 254 in FIG. 12 and may be termed the transfer station and packaging station handler logic. The transfer and packaging station handler logic 254 is responsive to the product sensor 204 which provides an interrupt pulse with each passage of an envelope into the transfer station 42. The transfer and packaging logic 254 is operative to actuate a solid state relay in a timing circuit (not shown) which is operative to energize the transfer station solenoid 186 and effect predetermined timed sequencing of the pusher cylinder 214, the presser cylinder 216 and the vacuum drawdown for the carton blanks within the hopper 222. Such timing control circuit may be of conventional design operative to provide the desired time sequencing of the transfer mechanism and packaging station functions.

System shutdown logic is indicated at 258 in FIG. 12 and is operative to effect actual shutdown of the envelope processing system 10 in the event any of the photoelectric sensors 92 and 230 detect absence of envelopes or cartons within their respective hoppers, or the envelope feed sensors 96 on the main feeder and inserters fail to detect an envelope being properly fed onto the conveyor means 22, or in the event of a double feed or one of the product, printing or carton sensors 144, 150 and 232, respectively, failing to sense a proper corresponding function. Such error detection is indicated as "jam detect" in the task control logic of FIG. 12 and is fed to the system shutdown logic 258 which interfaces with error shutdown logic indicated at 260 within the data processor 240 to in turn disable or enable the various task logics 250, 252 and 254.

Control of the envelope processing system by the data processor 240 and the task control logic is illustrated in the logic diagram of FIG. 13. Each of the main envelope feed 12 and insert envelope feeds or inserters 28*a–d* has a table that resides in memory within the data processor 240 and each of these tables has a series of entries which determine whether or not the corresponding envelope feeder or inserter is on or off in response to each pulse of the shaft encoder interrupt 126. Each table has its own pointer which is either incremented forwardly or reset back to zero depending upon whether or not the last entry in a particular table has been reached. Referring to FIG. 13, the logic for feeding of the primary and inserter envelopes and printing of the primary envelopes by the printer means 18 is indicated by blocks indicated with reference numeral 250 followed by an alphabetical letter. Block 250*a* indicates a wait for an interrupt signal from the shaft encoder 126 which provides proper timing for feeding of a primary envelope from the hopper 16 onto the conveyor means 22. Block 250*b* receives the initial entry form the table for the primary envelope feeder 12. Block 250*c* indicates that the control solenoid for the initial hopper sucker block vacuum and the feeder solenoid 88 are either energized or disabled depending upon the initial table entry for the primary feeder 12. Block 250*d* comprises a decision block which checks the last table entry for the primary envelope feeder 12. If the last entry received by block 250*b* is the last entry in the table for the primary envelope feeder, block 250*e* checks to see if it is the last set of envelopes to be fed from the primary envelope hopper 16. If, in fact, it is the last set, than no other action is taken and the logic for the primary envelope inserter or feed means 12 is fully executed. If it is not the last set of envelopes to be processed by the primary envelope feeder 12, the primary envelope hopper table is pointed back to the beginning for recycling as indicated by block 250*f*.

Block 250*g* is the logic that is applied if the last table entry received by block 250*b* for the primary envelope hopper is not the last table entry. Block 250*g* indicates that the table in the data processor 240 for the primary envelope feeder has been incremented to its next entry. Block 250*h* indicates that the table entry for the first inserter 28*a–d* which is to be activated for a given set of envelopes, normally the inserter 28*d*, is retrieved from memory in the data processor 240. Block 250*i* indicates that the vacuum solenoids controlling vacuum to the upper and lower sucker blocks for the inserter selected in block 250*h* are energized to connect the upper and lower sucker blocks to vacuum. Block 250*j* indicates that the inserter feed solenoid, corresponding to the feed solenoid 88 described in connection with the primary feed means 12, is energized to effect feeding of the bottom insert envelope from the hopper 32*d* into the associated feed belts to advance it to the conveyor means 12 in response to a space having been previously provided between primary envelopes fed from the primary feed means 12. Feeding of the insert envelope is synchronized with movement of the predetermined space between the primary envelopes so that the corresponding insert envelope is inserted onto the conveyor means 22 into the proper space provided for this purpose.

Block 250*k* indicates that the feed solenoid and the control solenoid for the upper sucker block of the inserter selected by block 250*h* have been deenergized so as to reset these solenoids immediately following entry of an insert envelope into the corresponding feeder belts, while the lower sucker block remains connected to suction. After the lower sucker block has engaged the descending insert envelope and guided it onto the underlying conveyor means 22, the corresponding suction control solenoid to the lower sucker block is terminated. This reset of the lower sucker block vacuum solenoid is indicated by block 250*m*. Block 250*n* follows the same last table entry for the inserter selected by block 250*h* as the aforedescribed block 250*d* for the primary envelope inserter logic. Similarly, block 250*p* checks the last table entry for the inserter table received in block 250*h* to see if it represents the last set. If it is the last set, no other action is taken. If it is not the last set, block 250*q* causes the pointer for the insert table to point to the beginning of the inserter table. Block 250*r* is the logic that is taken if the last entry for the inserter table received by box 250*h* has not been reached, thus indicating that the table is incremented to its next entry.

Summarizing the logic of the first task 250, this logic awaits the shaft encoder interrupt, retrieves the table entry for the primary envelope feeder 12 and all four inserters 28*a–d* and, based on these table entries, either energizes or deenergizes each individual solenoid controlled element by appropriate command signals. The tables for the various envelope feeders and inserters are incremented through and the pointers are incremented at the end of each logic group along with a check for the last table entry and last set of envelopes as established by the data processor 240. Preferably, a last logic (not shown) is executed by the first task logic 250 to check all product sensors for envelopes coming out of the hoppers that were actually fired.

The logic corresponding to the second task logic 252 for the ink jet printer of the second printer means 38 is indicated by the blocks shown at reference numeral 252 with associated alphabetical letters. Block 252*a* indicates a reset of the print detect enter routine which calls for checking of the print density by the color scanner sensor 150. Block 252*b* receives the current text entry from the text table in the memory of the data processor 240 and prepares it for printing by the printhead 130. Block 252*c* is a decision block which refers to a check for the end of the text table to indicate whether the end of the envelope set has been reached. The set count is incremented by one as indicated at block 252*d* and a check is made for the end of job by a decision block 252*e*. If the end of the job is not indicated, block 252*f* points to the beginning of the text table. If the end of the job is detected, block 252*g* deactivates the ink jet printer task. Block 252*h* refers to the product sensor 144. When a product is sensed by the sensor 144, the text entry that was prepared in block 252*b* is sent to the control console 138 for the printhead 130 to effect printing as indicated by block 252*i*. Block 252*j* indicates wait for the print sense entry from detect sensor 150 which was reset in block 252*a*. If print of proper density is detected by the sensor 150, the text table is incremented to the next entry by block 252*k* and the logic returns to start to wait for the next envelope to come through the second printer 38.

The logic for the transfer and packaging station, indicated schematically at 254 in FIG. 12, is indicated in the block diagram logic of FIG. 13 by blocks identified with reference numerals 254 and alphabetical letters. Block 254*a* indicates wait for an envelope to be sensed by the envelope sensor 204 which is located between the printhead 130 and the transfer station 42. Block 254*b* represents count logic which is incremented by one with each interrupt provided by detection of an envelope by the sensor 204. Block 254*c* is a decision block which checks for the end of the set. If the end of a given set has not been reached, a "no" branch goes back to the first block 254*a* and waits for the next envelope to be sensed by the sensor 204. If the end of a given set has been reached, a check is made by a decision block 254*d* for presence of a properly erected carton in the envelope insert position 212 as detected by the photoelectric sensor 232. If a carton is not properly positioned and detected by the sensor 232, logic block 254*e* causes the system to be deactivated and the error shutdown logic 260 takes over.

If the carton sensor 232 detects a carton in the envelope loading station 212 preparatory to inserting a set of envelopes therein, logic block 254*f* causes the turner members 154*a, b* to dump or drop the set of envelopes therein to the underlying envelope receiving tray 210 which, as aforedescribed, is controlled by a timing circuit operative to effect predetermined sequential operation of the carton loading cylinder 214 and presser cylinder 216 and insert the compressed envelopes into the properly positioned carton.

Logic block 254*g* indicates a reset of the packaging solenoid to be reset after approximately 10 milliseconds to prepare it for transfer of the next set of envelopes conveyed to the transfer mechanism 42. Once the packaging solenoid is reset, logic block 254*h* operates to check for the end of the set or end of the job. Simultaneously, the envelope count is reset back to "1", a check is made by decision block 254*i* for the end of the job. If the end of the job is not indicated, the logic returns back to block 254*a* to await the next envelope. If the end of the job is indicated, the packaging station is purged after disabling of the vacuum to the drawdown mechanism for the next carton blank in the carton hopper 222 as represented by logic blocks 254*j* and 254*k*. Purging of the packaging station comprises driving the conveyor 224 forwardly to move the remaining filled cartons out of the packaging station preparatory to beginning the next job.

Thus, execution of each of the individual logic tasks 250, 252 and 254 is based on a process interrupt to the data processor 240. The process interrupts for the ink jet printerhead 130 and associated control console 138 are generated by sensors 144 and 150. The process interrupts for the transfer and packaging stations 42 and 46, respectively, are generated by the photoelectric sensors 204, 230, 232 and 234. The process interrupts for the primary envelope feed means 12 and inserters 28*a–d* are generated by the shaft encoder 126 which is adapted to establish a process interrupt or pulse signal upon each movement of the conveyor means 22 by a distance substantially equal to the major longitudinal dimension of one of the envelopes being handled by the envelope processing system 10. By process interrupt is meant that the photoelectric sensors make or break a photosensor contact and/or that the shaft encoder 126 presents a make or break 5 volt pulse to the data processor 240. The various logic tasks 250, 252 and 254 run concurrently as if each were a separate entity.

In addition to the logic described, data used in setting up the various logic tables for the envelope feeders and inserters, the transfer and packaging stations, and the text table for the ink jet printer may be contained on a job diskette that is inserted into a data processor 240 at the beginning of each job. The diskette contains all of the information pertaining to the indicia which is to be printed on each successive envelope by the printhead 130, how many envelopes there are to be in each set, how many sets there are in each job, and how many total envelopes are to comprise a complete job. In addition, the diskette provides information for setting up the memory table for each of the primary and insert envelope hoppers and feeders.

Thus, in accordance with the present invention, a system for processing envelopes and the like is provided which effects substantially totally automatic operation in the making up or processing of sets of envelopes comprising primary envelopes on which common indicia is printed and between selected ones of which insert or special envelopes are inserted, followed by printing individualized indicia on each successive envelope in the set and thereafter automatically transferring and packaging each set of envelopes into a carton until a desired job lot has been completed. By providing for high speed in-line printing of individualized data, such as a date and a customer serial number or the like, on each successive envelope in a set, including both primary and insert envelopes, should the number of envelopes desired for a particular set be varied as by being reduced, no waste of insert envelopes results. The nonused insert envelopes may be returned to storage and used on a subsequent job having its own individualized indicia on each envelope. Moreover, by providing a fully automatic processing system, it is believed that substantial labor expense savings will be realized with resulting production costs of the final printed envelopes being substantially reduced.

While a preferred embodiment of the present invention has been illustrated and described, it will be apparent to those skilled the art that changes and modifications may be made therein without departing from the invention in its broader aspects. Various features of the invention are defined in the following claims.

What is claimed is:

1. A system for processing envelopes and the like comprising:

conveyor means adapted to receive and convey envelopes in a continuous stream along a predetermined path;

first feed means, adapted to support a plurality of primary envelopes in a generally upstanding stack, for sequentially feeding said primary envelopes in a continuous stream onto said conveyor means and for interrupting said continuous stream to leave selcted spaces in said stream in response oto first predetermined command signals;

first printer means, cooperative with said conveyor means, for printing indicia on envelopes fed onto said conveyor means by said first feed means in response to first print command signals;

at least one inserter means, adapted to support a plurlaity of insert envelopes in a generally upstanding stack and cooperative with said conveyor means, for feeding said insert envelopes onto said conveyor means in said selected spaces in response to predetermined inserter command signals;

second printer means, cooperative with said conveyor means and operative in response to predetermined second print command signal, for printing individualized indicia on each successive primary and insert envelope passed along said predetermined path by said conveyor means; and control means operatively associated with said conveyor means, first feed means, inserter means and first and second printer means, said control means being adapted to provide said first predetermined command signals, said inserter command signals and said first and second print command signals in a predetermined sequence so as to automatically establish predetermined spacing between successive primary envelopes fed onto said conveyor means, cause successive primary envelopes to be printed by said first printer means, cause insert envelopes to be inserted into said selected spaces between said primary envelopes created for this purpose, and effect printing of individualized indicia on each success ive envelope by said second printer means.

2. A system for processing envelopes and the like as defined in claim 1 further including:

transfer means adapted to receive envelopes from said second printer means, said transfer means being operative in response to a predetermined command signal to transfer envelopes received therein the a packaging position.

3. A system for processing envelopes and the like as defined in claim 2 further including:

a packaging station adapted to receive envelopes in set quantity from said transfer means, said packaging station being adapted to insert sets of envelopes in cartons.

4. A system for processing envelopes and the like as defined in claim 1 wherein said control means includes:

an encoder adapted to provide periodic pulse signals in predetermined timed relation to movement of said conveyor means.

5. A system for processing envelopes and the like as defined in claim 4 wherein said control means further includes:

primary envelope sensor means operatively associated with said first feed means and operative to detect feeding of a primary envelope onto said conveyor means preparatory to printing indicia theron by said first printer means; and said control means being operative in response to detection of a primary envelope by said primary envelope sensor to effect printing by said first printer means and operative to disable said first printer means in response to failure of said primary envelope sensor means to detect a primary envelope following application of a first command signal to said first feed means.

6. A system for processing envelopes and the like as defined in claim 1 wherein:

said first feed means and said inserter means each include an envelope storage hopper; and said control means including sensor means mounted on each of said envelope hoppers to detect the level of envelopes supported therein.

7. A system for processing envelopes and the like as defined in claim 1 including:

sensor means operatively associated with said first feed means and said inserter means and adapted to detect feeding of more than one envelope from either of said first feed means or said inserter means; and said control means being responsive to detection of simultaneous feeding of more than one envelope from said first feed means or inserter means to disable said conveyor means, said first feed means, said inserter means, said first printer means, and said second printer means.

8. A system for processing envelopes and the like as defined in claim 1 including;

envelope sensing means operatively associated with said second printer means in proximate relation thereto, said envelope sensing means being adapted to provide a pulse signal upon detection of each successive envelope conveyed to said second printer means on said conveyor means; and said control means being operative to disable said second printer means in the event said envelope sensing means fails to detect an envelope conveyed in predetermined timed relation from said first feed means or said inserter means.

9. A system for processing envelopes and the like as defined in claim 7 wherein:

said control means includes sensor means operatively asociated with said second printer means in a manner to detect printing applied to said successive envelopes by said second print means; and said control means being operative to disable said second print means in response to detection of a predetermined quality of print applied by said second means.

10. A system for processing envelopes and the like as defined in claim 2 wherein:

said control means includes envelope sensor means disposed between said second printer means and said transfer means and adapted to enable conunting of envelopes conveyed by said conveyor means to said transfer means; and said control means being responsive to a predetermined number of envelopes sensed by said envelope sensor means to effect actuation of said transfer means.

11. A system for processing envelopes and the like as defined in claim 1 wherein said control means includes:

a data processor adapted to effect said predetermined timed relation of said first predetermined command signals, said inserter command signals, and said first and second print command signals.

12. A system for processing envelopes and the like as defined in claim 1 wherein said first feed means and said inserter means each includes:

feed belt means; and presser belt means cooperative with the associated feed belts and operative to effect positive selective feeding of said primary and insert envelopes onto said conveyor means.

13. A system for processing envelopes and the like as defined in claim 1 including:

a plurality of said inserter means; and said control means being operative to feed insert envelopes from said inserter means onto said conveyor means in a predetermined sequence.

14. A system for processing envelopes and the like as defined in claim 1 wherein:

said control means in operative to establish predetermined spaces between selected ones of said primary envelopes fed from said first feed means and effect insertion of an insert envelope into each of said predetermined spaces from selected ones of said inserter means.

15. A system for processing envelopes and the like as defined in claim 3 wherein:

said transfer means includes a pair of parallel turner means adapted to receive envelopes from said conveyor means in stacked relation; and said control means being operative to effect rotation of said turner means in a manner to transfer said stacked envelopes to said packaging means.

16. A system for processing envelopes and the like as defined in claim 15 wherein:

said control means includes means for enabling said rotation of said turner members automatically after a predetermined number of envelopes are received by said turner members.

17. A system for processing envelopes and the like as defined in claim 1 further including transfer means comprising:

first means defining an envelope receiving station positioned in said predetermined path and adapted to receive envelopes in sequential order as they are conveyed along said path; and second means located within said receiving station and movable between a first position and a second position adapted to receive a predetermined number of sequentially conveyed envelopes in generally vertically stacked relation and to transfer the envelopes generally vertically downwardly.

18. A system for processing envelopes and the like as defined in claim 17 wherein:

said second means includes a pair of parallel turner members adapted when in said first position to receive envelopes in stacked relation, said turner members being rotatable in a manner to transfer said stacked envelopes vertically downwardly.

19. A system for processing envelopes and the like as defined in claim 18 further including:

means enabling rotation of said turner members automatically when a predetermined number of envelopes are received by said turner members.

20. A system for processing envelopes and the like as defined in claim 18 wherein:

each of said turner members defines four open quadrants abouts its longitudinal axis, said turner members being mutually cooperable so that envelopes are received within two opposed quadrants thereof when said turner members are in said first position.

21. A system for processing envelopes add the like as defined in claim 20 including:

means interconnecting said turner members so as to effect equal angular rotation thereof about their longitudinal axes in opposite rotationAI directions.

22. A system for processing envelopes and the like as defined in claim 21 including:

means enabling incremental 180° rotation of said turner members in response to predetermined command signals.

23. A system for porcessing envelopes and the like comprising:

conveyor means adapted to receive and to convey a continuous stream of envelopes along a predetermined path;

first feed means adapted to support a plurality of primary envelopes in a genreally upstanding stack and sequentially feed said envelopes onto said conveyor means in response to first predetermined command signals, said first predetermined command signals generated such that envelopes are fed to said conveyor means to form said contiunuous stream and are inhibited at predetermined times to leave selected spaces in said stream;

at least one inserter means adapted to support a plurality of insert envelopes in a generally upstanding stack, said inserter means, in response to predetermined inserter command signals, cooperating with said conveyor means to feed said insert envelopes into said spaces of said envelope stream while said envelops are being conveyed along said predetermined path by said conveyor means;

printer means cooperating with said conveyor means and operative in response to predetermined print commands signals to print individualized indicia on each successive primary envelope and insert envelope conveyed Along said predetermined path by said conveyor means; and control means, operatively associated with said conveyor means, first feed means inserter means, and printer means, said control means being adapted to generate said first predetermined command signal, said inserter command signals, and said print signals in sequence so as to automatically establish predetermined spacing between successive primary envelopes, cause the feeding of insert envelopes into said selected spaces in the envelope stream created for that purpose, and effect printing of individualized indicia on each successive envelope by said printer means.

24. A system for processing envelopes and the like as set forth in claim 23 which further includes:

primary printer means cooperating with said converyor means and adapted to print indicia on envelopes fed onto said conveyor means by said first feed means in response to primary print command signals; and said control means operatively associated with said primary printer means, said control means being adapted to generate said primary print command signals in said predetermined sequence so as to cause successive primary enveloped to be printed by said primary printer means.

25. A system for processing envelopes and the like as set forth in claim 23 which further includes:

second printer means cooperating with said conveyor means and adapted to print indicia on envelopes fed onto said conveyor means by said first feed means in response to second print command signals; and said control means operatively associated with said second printer means, said control means being adapted to generate said second print command signals in said predetermined sequence so as to cause successive primary and insert envelopes to be printed by said second printer means.

26. A system for processing envelopes and the like as set forth in claim 23 wherein:

said conveyor means transports said continuous envelope stream in the direction of the major longitudinal axis of said envelopes; and said printer means serially prints said individualized indicia on a print line parallel with the major longitudinal axis of said envelopes while they are being conveyed along said predetermined path by said conveyor means.

27. A system processing envelopes and the like as set forth in claim 26 wherein:

said printer means serially prints said individual indicia on a plurality of print lines parallel with the major longitudinal axis of said envelopes.

28. A system for processing envelopes and the like as set forth in claim 26 wherein:

said individualized indicia form a name with a corresponsing address.

29. A system for processing envelopes and the like as set forth in claim 26 wherein:

said individualized indicia form sequential numbers of a predetermined series.

30. A system for processing envelopes and the like as set forth in claim 23 wherein:

said printer means comprises a stationary ink jet receiving said printer command signals which serially prints on at least one print line parallel to the major longitudinal axis of each envelope.

31. A continuous envelope processing method for church offering envelope sets wherein each set comprises a plurality of primary envelopes and at least one special insert envelope in a predetermined sequence and wherein each of the envelopes of a set has alphanumeric indicia printed on at least one print line parallel with the major longitudinal axis of the envelopes; said method comprising the steps of:

feeding primary envelopes in a continuous stream from a first supply of envelopes onto a conveyor means such that the movement of the primary envelopes is parallel to said print line;

interrupting said continuous stream of primary envelopes at timed intervals such that a selected space is left in the continuous flow of envelopes;

inserting in the said selected space said at least one spacial insert envelope from a second supply of envelopes; and serially printing the alphanumeric indicia on each envelope as it moves along said conveyor means.

32. A method of envelope processing as set forth in claim 31 which further includes the step of:

printing said envelopes, after said inserting step, with at least one other indicia.

33. A method of envelope processing as set forth in claim 31 which further includes the step of:

printing said envelopes, before said inserting step, with at least one other indicia.

34. A method of envelope processing as set forth in claim 31 wherein said printing step includes:

printing said alphanumberic indicia as a name and a corresponding address.

35. A method of envelope processing as set forth in claim 31 wherein said printing step includes:

printing said alphanumeric indicia as a numberial sequence.

36. A method of envelope processing as set forth in claim 31 wherein said printing step includes:

printing said alphanumeric indicia serially along said at least one print line.

* * * * *